343-700 S A 256 E
9/4/79 04 4,167,010

343/700MS United States Patent [19]
Kerr

[11] 4,167,010
[45] Sep. 4, 1979

343/700MS

[54] TERMINATED MICROSTRIP ANTENNA

[75] Inventor: John L. Kerr, Monmouth County, N.J.

[73] Assignee: The United States of America as represented by the Secretary of the Army, Washington, D.C.

[21] Appl. No.: 885,727

[22] Filed: Mar. 13, 1978

[51] Int. Cl.² ..... H01Q 1/38
[52] U.S. Cl. ..... 343/700 MS; 343/846; 343/830
[58] Field of Search ..... 343/700 MS File, 854, 343/769, 846, 829, 830

[56] References Cited

U.S. PATENT DOCUMENTS 4,053,895 11/1977 Malagisi ..... 343/700 MS
4,079,268 3/1978 Fletcher et al. ..... 343/700 MS

*Primary Examiner*—David K. Moore
*Attorney, Agent, or Firm*—Nathan Edelberg; Sheldon Kanars; Bernard Franz

[57] ABSTRACT

A microstrip antenna design according to which a plurality of resonant frequencies can be obtained for a given size radiator, to increase the usefulness of the antenna by providing for frequency diversity operation and by making the microstrip antenna tunable over a range of frequencies. As will be seen, the microstrip antenna is provided with an output termination which can be open-circuited or short-circuited, and at varying lengths, to change the frequency at which the microstrip antenna can be made resonant.

8 Claims, 10 Drawing Figures

TERMINATED MICROSTRIP ANTENNA

The invention described herein may be manufactured and used by or for the Government for governmental purposes without the payment of any royalties thereon or therefor.

FIELD OF THE INVENTION

This invention relates to microstrip antennas and, more particularly, to an antenna design which permits a single antenna construction to operate over a range of frequencies with acceptable voltage-standing-wave-ratios (VSWR).

BACKGROUND OF THE INVENTION

As is well known and understood, a microstrip antenna is a printed circuit device in which the radiating element is typically a rectangular patch of metal etched on one side of a dual-clad circuit board. As is also well known and understood, the microstrip antenna is a narrow band device which operates at a single resonant frequency. If different resonant frequencies are desired, then different circuit board constructions are needed, either changing the dielectric constant of the circuit board material for a given element size, or changing the size of the radiating element for the same dielectric constant. If it were desired to use such microstrip antennas in secured communications systems, Identification Friend or Foe systems or similar systems requiring operation in two or more discrete bands, it will be readily apparent that such arrangement would be fairly cumbersome and of increased manufacturing cost.

SUMMARY OF THE INVENTION

As will become clear hereinafter, the microstrip antenna design of the invention follows from a finding that the resonant frequency of a given size radiator can be changed by providing it with an output termination, and by open-circuiting or short-circuiting that termination. With the additional finding that the location of the open-circuit or short-circuit measured with respect to the output termination will determine the frequency at which the antenna resonates, it becomes possible to operate the antenna at different frequencies simply by positioning the open-circuit and short-circuit positions. When added to the further finding that the resonant frequency will change from an open-circuit termination to a short-circuit termination, it will thus be apparent that a tunable microstrip antenna can be easily fabricated, simply by varying the termination length and/or the output condition, either open-circuit or short-circuit. As will also be readily apparent to those skilled in the art, the open-circuit and short-circuit conditions and locations can be changed either locally or remotely, as by electronically controlling the effective length of a strip line set up to permit diverse frequency operations.

BRIEF DESCRIPTION OF THE DRAWINGS

These and other features of the present invention will be more clearly understood from a consideration of the following description, taken in connection with the accompanying drawing in which.

DETAILED DESCRIPTION OF THE DRAWINGS

Figure 1:
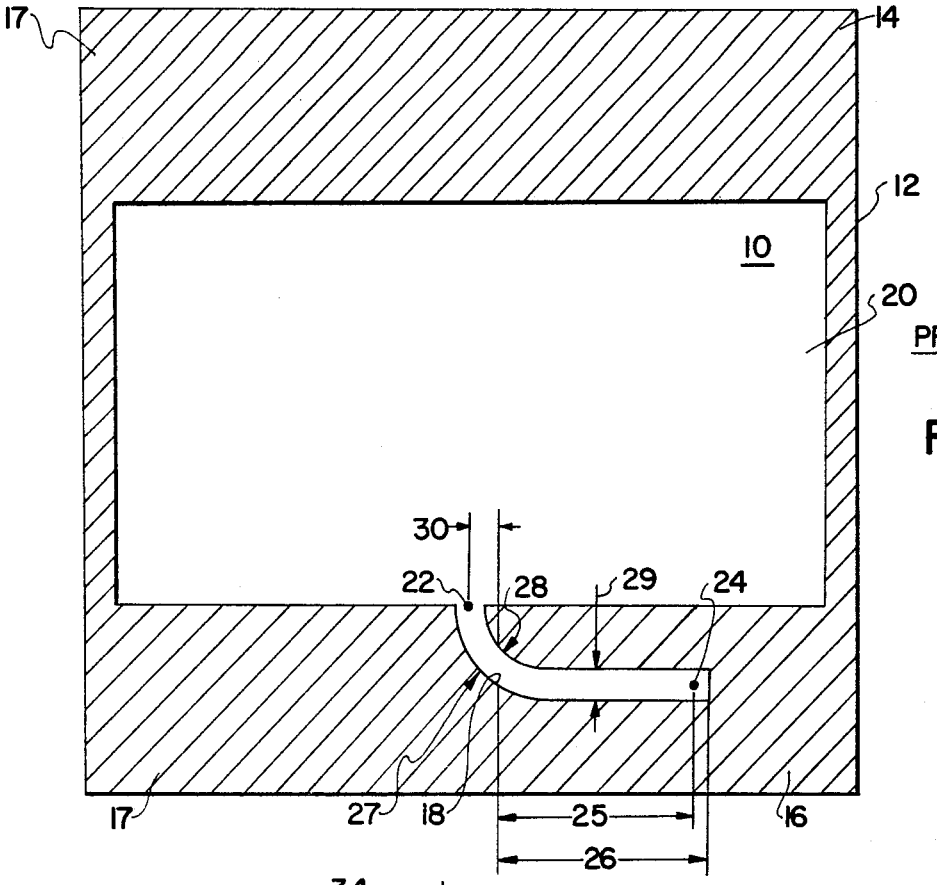
PRIOR ART FIG.1
FIG. 1 shows a microstrip antenna constructed in accordance with the prior art.

In FIG. 1, the microstrip antenna 10 is shown as comprising a circuit board 12, the back side of which (not shown) is clad entirely of a metal material, typically copper. In conventional constructions, the front side of the circuit board is clad of like material, except in the areas 14 and 16, where the metal is etched away to reveal the dielectric material 17 underneath. (In the preferred embodiments of the invention described, dielectric materials available under the tradenames Polyguide and Duroid were employed.) A section of metal extends from the rectangular metal plate 20 so formed, to operate as a microstrip transformer in matching the impedance at the input to the patch 22 to the impedance at the signal imput jack 24, usually the output from a coaxial cable coupled through the back side of the circuit board 12. In one embodiment of the construction, a circuit board clad with copper 1½ mils thick overlying a ⅛ inch thick Duroid dielectric was employed for radiating in the L-band of frequencies. When constructed 4.655 inches on a side, and with the etched areas 14, 16 extending approximately 0.988 inches each, the microstrip antenna of FIG. 1 exhibits a resonant frequency of some 1370 MHz, and exhibits a resonant frequency characteristic as shown by the curve A in FIG. 3. The dimensions of the microstrip transformer 18, illustrated by reference numerals 25–30 were as follows:

Length 25—0.772 inches
Length 26—0.872 inches
Arc 27—0.600 inch radius
Arc 28—0.400 inch radius
Width 29—0.200 inches
Distance 30—0.500 inches, measured with respect to the vertical center line of the circuit board 12.

In accordance with the present invention, however, I have found that the resonant frequency of this described radiator can be changed by providing it with an output termination, and by open-circuiting or short-circuiting that termination. For example, and referring to the microstrip antenna of FIG. 2 (wherein like reference numerals are employed to identify parts corresponding to those in FIG. 1), I have found that if an output termination corresponding in dimension to the impedance matching input transformer were provided at the opposite side of the rectangular metal plate 20, and the short-circuited, that the resultant resonant frequency would be reduced to approximately 1360 MHz, with the resonant frequency characteristic then being shown by the curve B in FIG. 3. I have further found that if this output termination were open-circuited instead, the resonant frequency of the radiator would be increased to approximately 1410 MHz, with the microstrip antenna then having a resonant frequency characteristic as depicted by the curve C in FIG. 3. In other words, with the dimensions of this output termination 32 being as follows:

Length 33—0.772 inches
Length 34—0.872 inches
Arc 35—0.600 inch radius

Arc 36—0.400 inch radius

Width 37—0.200 inches

Distance 38—0.500 inches, measured with respect to the vertical center line of the circuit board 12, the resonant frequency of the microstrip antenna can be lowered by some 10 MHz or raised some 40 MHz simply by short-circuiting or open-circuiting, respectively, the output terminal 40 of the termination 32.

In the foregoing description, it will be understood that a coaxial connector was employed at the output terminal 40 to perform the short-circuiting and open-circuiting conditions.

Figure 3:
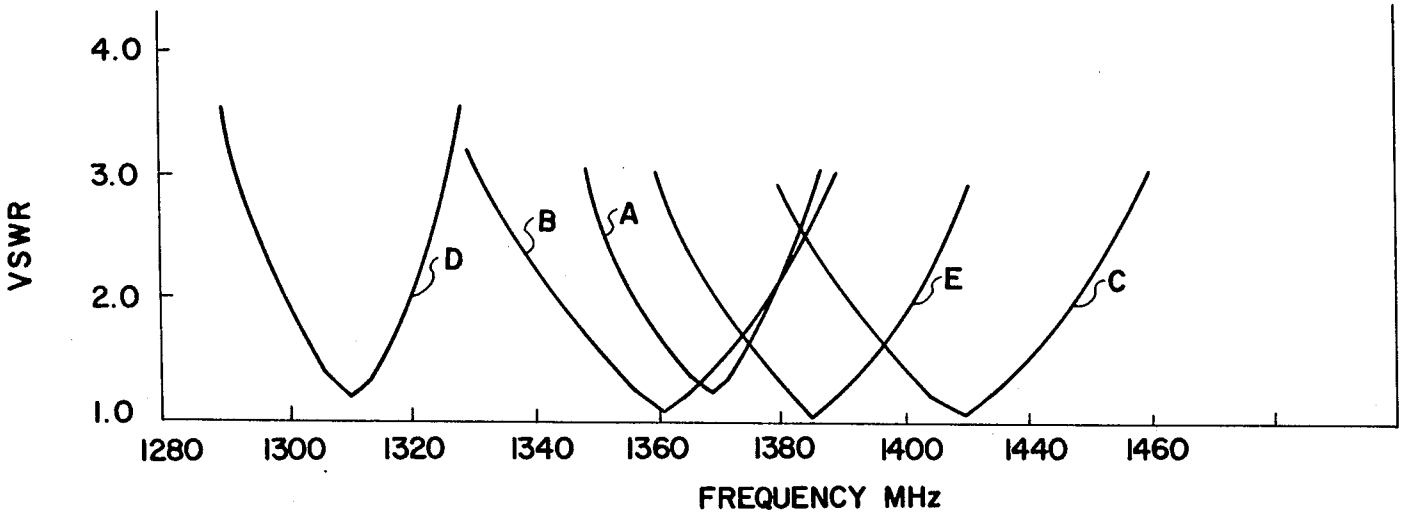
FIGS. 3 and 4 are a series of curves showing resonant frequency characteristics as exemplified by microstrip antennas constructed in accordance with the present invention.

I have further found that different changes in the resonant frequency could be effected by adding different lengths of coaxial line onto the connector, and then short-circuiting or open-circuiting their ends. For example, I have found that the microstrip radiator will resonate at 1310 MHz if a 2.55 cm coaxial line were added to the output connector and its remote end short-circuited, whereas a resonant frequency of approximately 1385 MHz would be exhibited if the remote end of that 2.55 cm line were open-circuited instead. Curves D and E in FIG. 3 illustrate the resonant frequency characteristics, respectively, for these conditions. Other resonant frequencies have been implemented by the addition of different lengths of coaxial line to the output connector at terminal 40, and altering the termination condition from short-circuit to open-circuit at the end of the added line.

Figure 4:
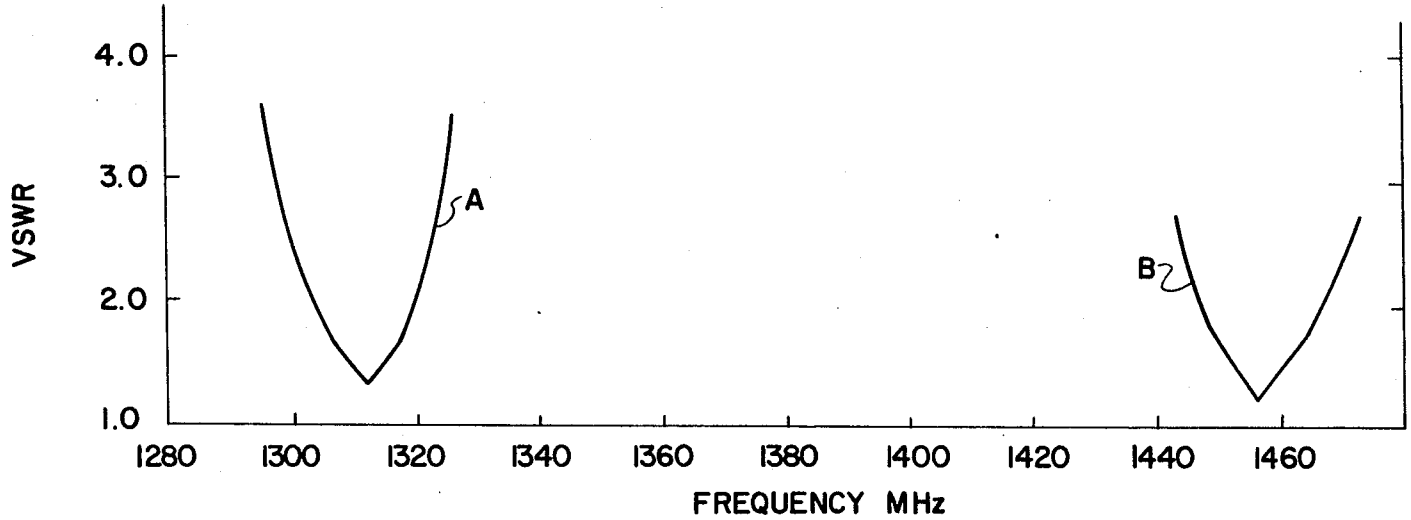

I have additionally found that it is possible to obtain double-resonance conditions from a microstrip radiator having a single length of short-circuited line added to the output connector. In particular, with a short-circuit condition providing a resonant frequency of 1312 MHz measured for a 2.55 cm line, the addition of an added length equal to $\lambda/2$ at this frequency, produces the original resonance at 1312 MHz, but a second resonance simultaneously at 1457 MHz, the overall length being then 13.8 cm from the output terminal 40. Such characteristics are illustrated by the curve A and B of FIG. 4. Experimentation has shown that it is possible to shift these two resonant frequencies by varying the length of the terminating line. Thus, in one experiment, one length of short-circuited line resulted in a resonant frequency of 1260 MHz and a VSWR of 1.58:1 at its low end, and a second, higher resonant frequency of 1400 MHz with a VSWR of 1.01:1. A second length of short-circuited line yielded a resonant frequency of 1330 MHz at a VSWR of 1.35:1, and a second resonance of 1450 MHz at a VSWR of 1.22:1. A further length experimented with, when short-circuited, yielded a resonant frequency of 1352 MHz at a VSWR of 1.14:1, and a higher resonance of 1500 MHz at a 1.48:1 VSWR. Analysis has shown that multiple resonances are also possible by further increases in the terminating line length as the impedance of the line repeats itself every one-half wavelength. Analysis has also indicated that similar double, triple, etc. resonances can be obtained by adding such lengths of line to the output terminal 40, and then open-circuiting their remote ends.

Figure 2:
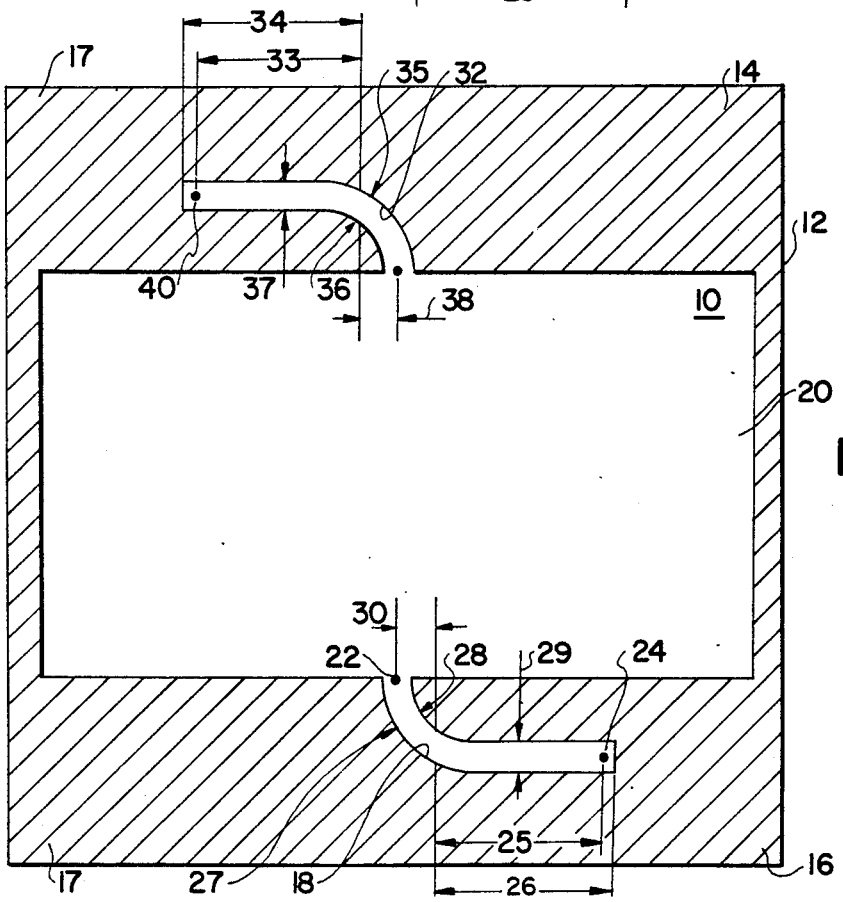
FIG. 2 shows a terminated microstrip antenna constructed in accordance with the invention.

I have also found that the micorstrip antenna configuration of FIG. 2 can be made tunable by terminating the output port 40 with a variable short-circuit length. Results using such technique are tabulated below for tuning to a minimum VSWR at the indicated frequencies by varying the length of the short-circuited line.

| f MHz | VSWR |
|---|---|
| 1200 | 1.80:1 |
| 1250 | 1.70:1 |
| 1300 | 1.35:1 |
| 1350 | 1.14:1 |
| 1400 | 1.01:1 |
| 1450 | 1.22:1 |
| 1500 | 1.48:1 |
| 1550 | 2.20:1 |

As will be readily apparent to those skilled in the art, these results indicate that a microstrip antenna terminated in accordance with the present invention can operate over a range of frequencies more than 200 MHz, and with a VSWR of less than 1.50:1, simply by having a calibrated length of line which can be short-circuited at select locations. The experimental results also indicated that the instantaneous bandwidth obtained is comparable to those of the curves of FIGS. 3 and 4, and the single microstrip antenna still operate narrow band. As will be understood, prior art teachings of microstrip antennas indicated the need for a different antenna configuration for each frequency of operation desired. Analysis has shown that not only will the variable short-circuit mode of working with a terminated line provide this tunable embodiment, but that similar tuning could be obtained with appropriate design of a variable open-circuited line.

Figure 5:
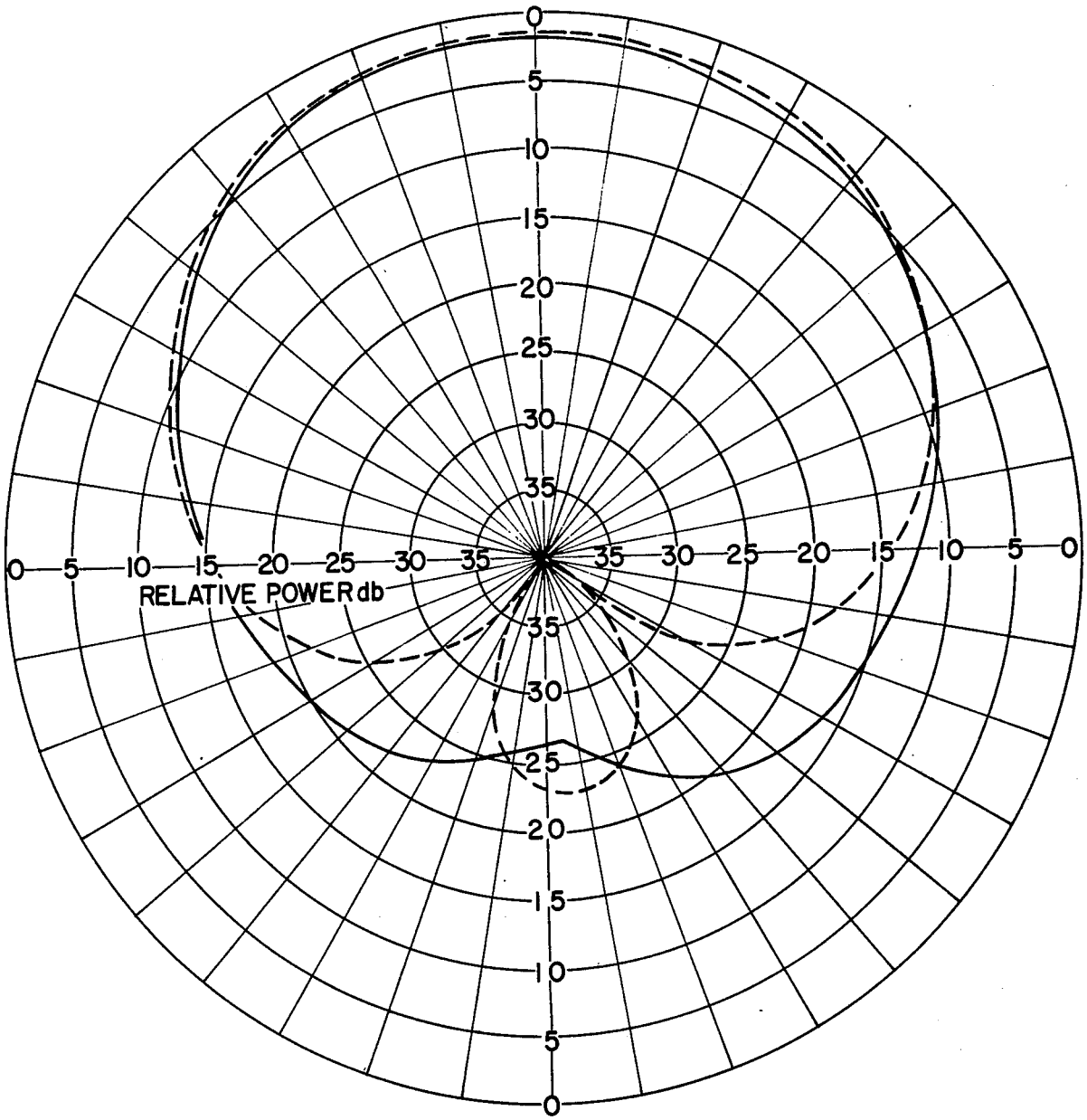
FIGS. 5–10 show typical radiation patterns obtained using the terminated microstrip antenna technique of the invention.
Figure 6:
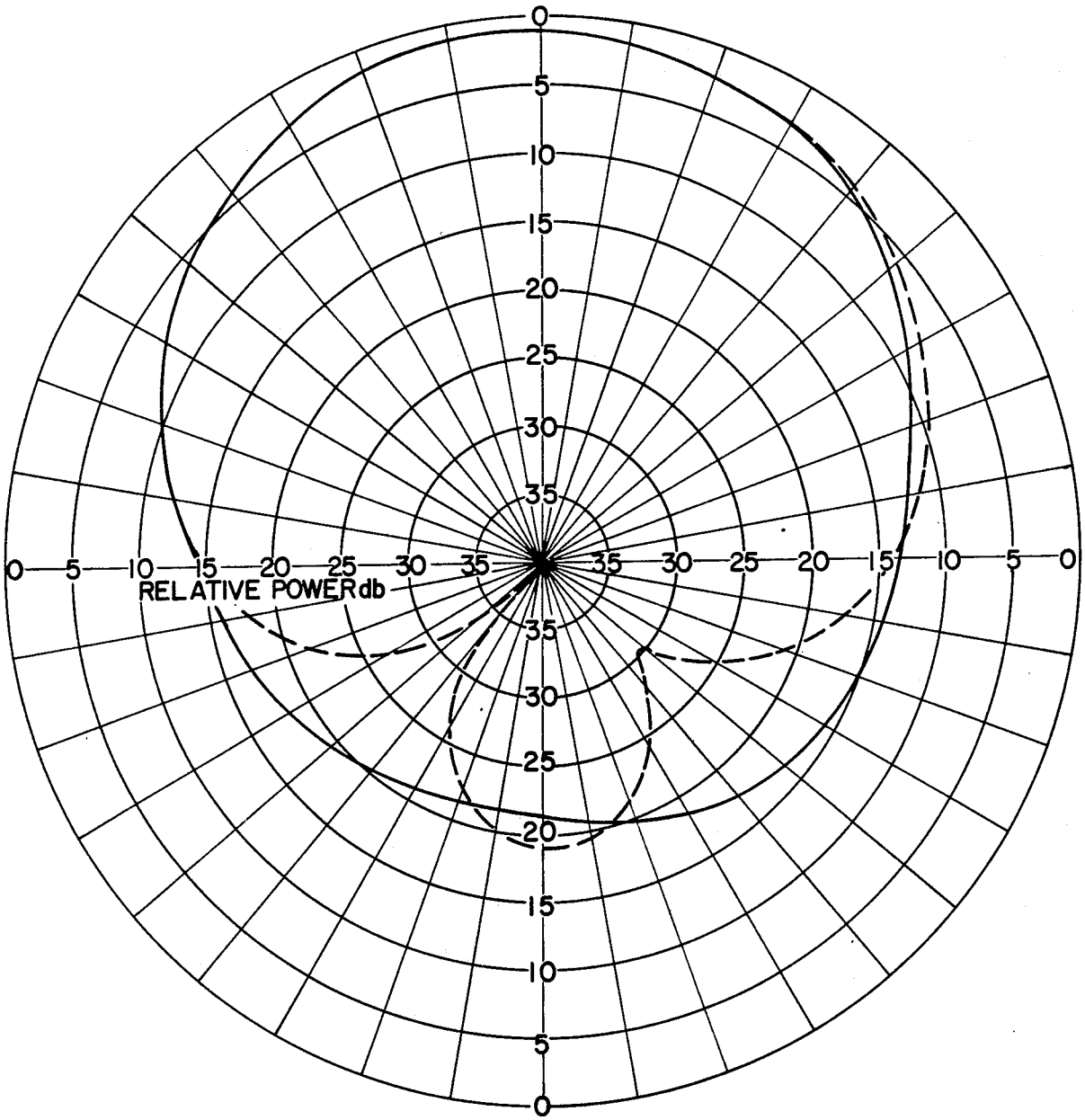
Figure 7:
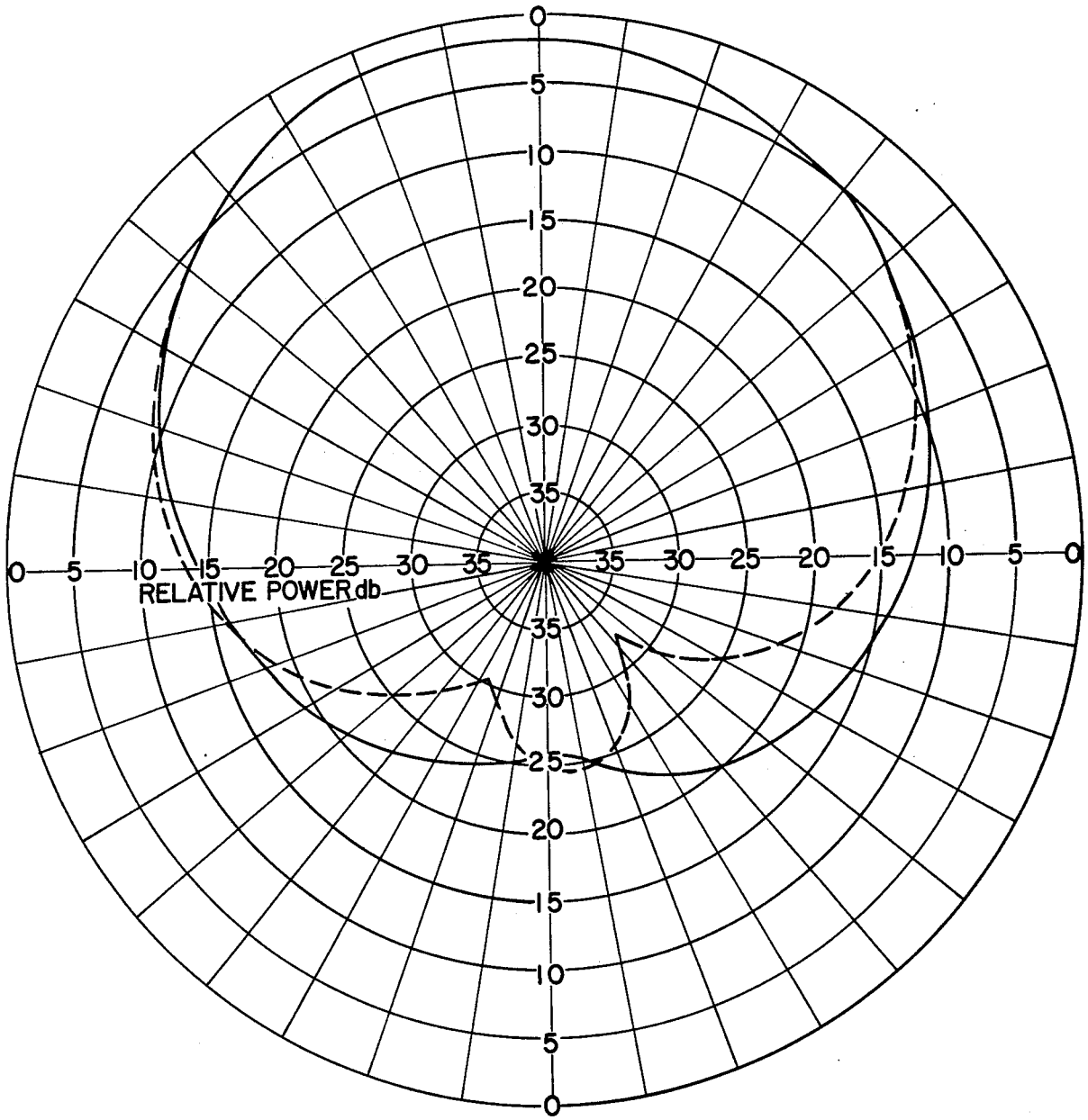
Figure 8:
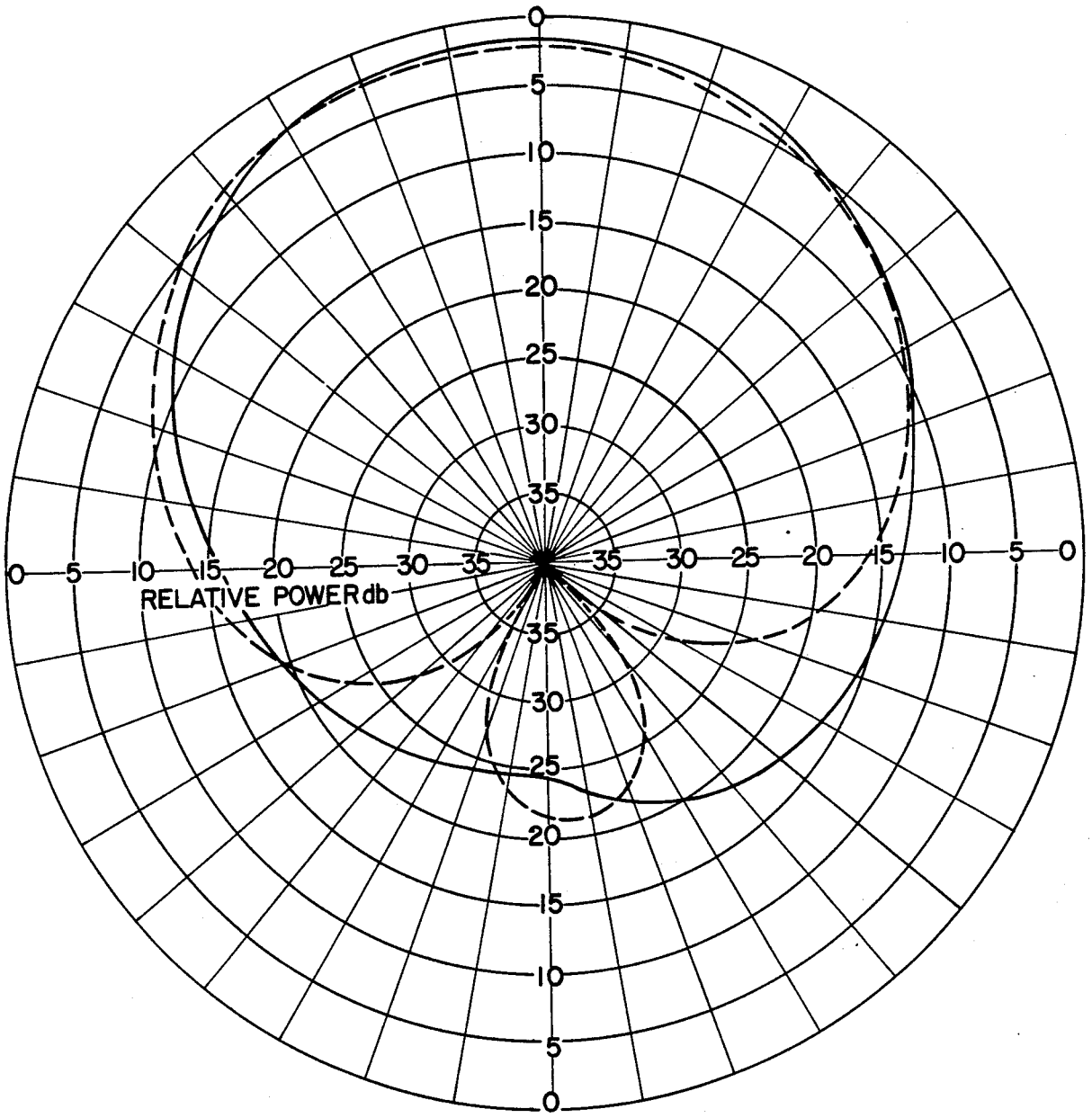
Figure 9:
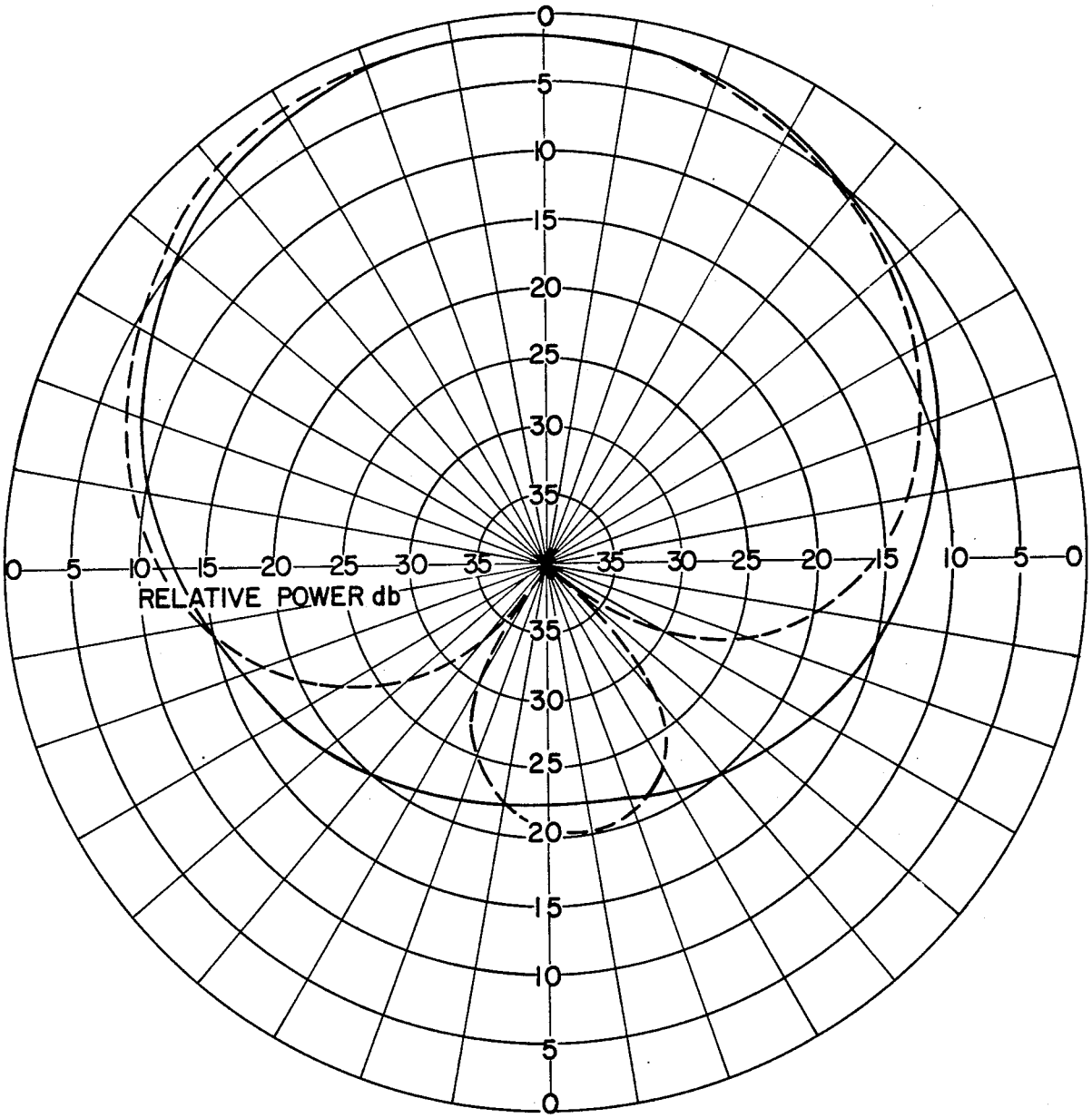
Figure 10:
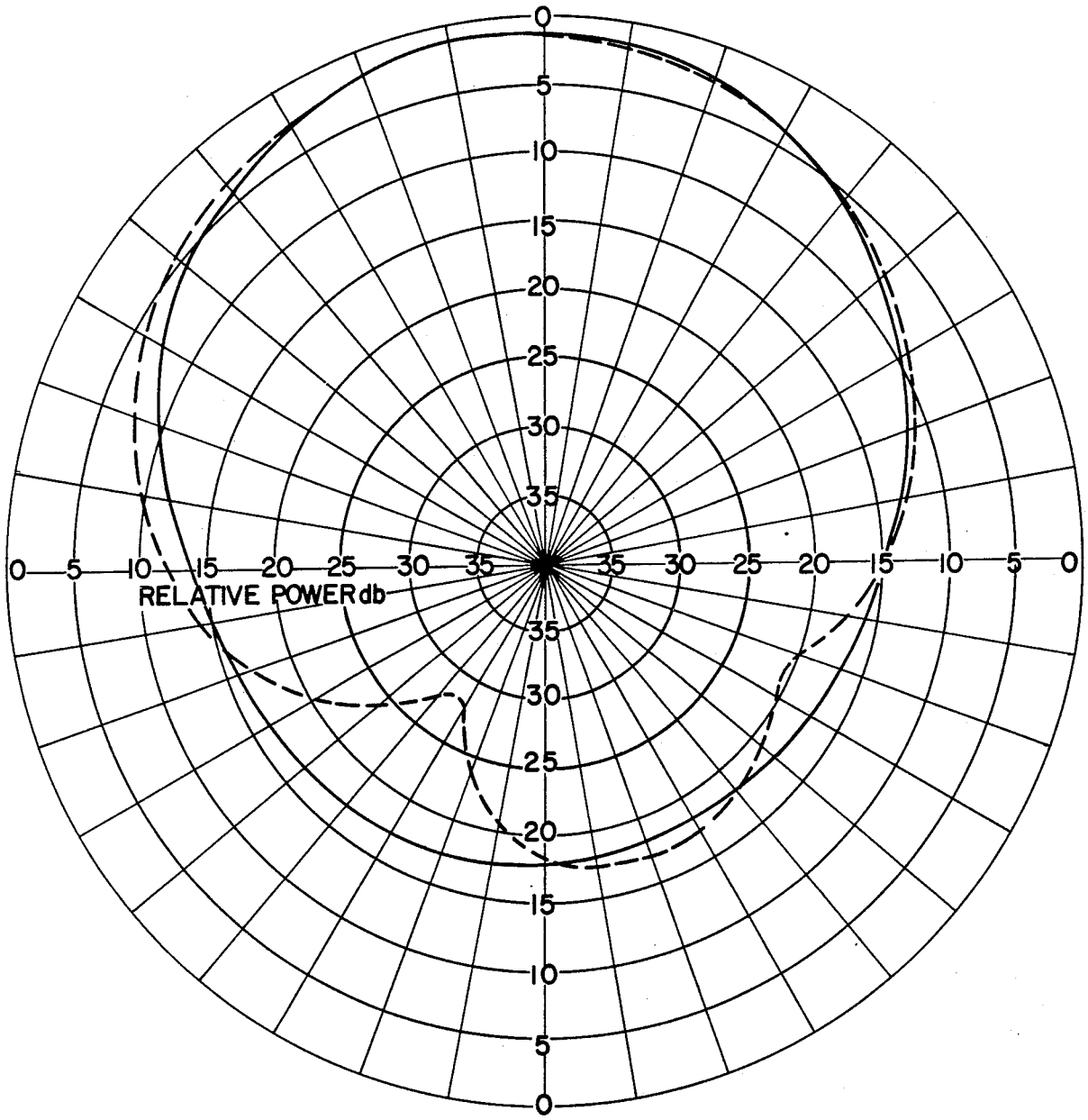

The radiation patterns of FIGS. 5–10 show typical E- and H- plane patterns for the terminated microstrip antenna of the invention, the "dashed" pattern being that for the E- plane and the "solid" pattern being that for the H- plane. In particular, FIG. 5 shows the pattern for the 1360 MHz operation with the output terminal 40 short-circuited, whereas FIG. 6 shows the pattern for the 1410 MHz operation with the output terminal 40 open-circuited; FIG. 7 similarly shows the radiation pattern for 1312 MHz with a short-circuit 2.55 cm from terminal 40, whereas the patterns of FIG. 8 show the operation at 1385 MHz for an open-circuit 2.55 cm from terminal 40; and the patterns of FIGS. 9 and 10 represent those obtained with a short-circuit condition 13.8 cm from the output terminal 40, the doubly resonant condition, in which FIG. 9 indicates the pattern at the lower resonance of 1312 MHz while FIG. 10 represents the pattern at the higher resonant frequency, 1457 MHz. As will be appreciated, any differences illustrated by these patterns obtained are very slight and insignificant.

In the simplest form of the invention, therefore, it will be seen that the microstrip antenna of the present invention provides an increase in usefulness by permitting a frequency diversity operation at two different frequencies, merely by changing the output termination from a short-circuit to an open-circuit condition. In transponder operation, for example, where transmissions are at one frequency and receptions are at another frequency, the usefulness of the terminated microstrip antenna will be evident, with the changes in termination being done manually, or made remotely through electromechanical or electronic means. For secured communications systems, or other arrangements requiring operation over two or more discrete bands, the tunable version of the invention will be seen to be the more attractive one, where different frequencies of operation can be had by terminating the line lengths at calibrated locations. Where the termination is to be by short-circuit, furthermore, it becomes a relatively easy matter to print a length of microstrip line on the microstrip circuit board itself, with apertures along the length thereof, for example, into which short-circuiting metallic pins could be inserted to provide the short-circuit termination at the desired location. With such a version, the simplicity of the approach of the invention, its associated low cost, and concomitant light weight will be apparent.

While there have been described what are considered to be preferred embodiments of the present invention it will be appreciated that changes may be made by those skilled in the art without departing from the scope of the teachings herein of changing the resonant frequency of a microstrip antenna by terminating the antenna with short-circuit or open-circuit conditions. For at least such reason, resort should be had to the claims appended hereto for a correct understanding of the scope of the invention.

I claim:

1. Microstrip antenna apparatus comprising:

a circuit board of dielectric material having front and back sides with a metallic ground plane on the back side thereof;

a radiating element in the form of a patch of metal etched on the front side of said board;

first transmission line means connected along a center line of said radiating element to a first point at one side of the center thereof for coupling to radio equipment;

second transmission line means connected along said center line of the radiating element to a second point at the opposite side of the center, terminated in an impedance very substantially different from the characteristic impedance so that the radiating element is tunable to resonant frequencies depending on the length of the second transmission line means and the value of said impedance, whereby the radiating element may be caused to resonate for a plurality of separate frequencies with the first transmission line means having a low standing wave ratio.

2. The apparatus of claim 1, wherein said radiating element is in the form of a rectangular patch of metal, and wherein said second transmission line means includes a microstrip line etched on the front side of said board from said second point to a third point to form a terminating impedance transformer.

3. The apparatus of claim 2, further including a coaxial jack mounted on said back side of the board with a center conductor connected through the circuit board to said third point and an outer conductor connected to said ground plane, wherein said impedance terminating the second transmission line means is selectively either an open circuit at said jack or a short circuit formed by placing a shorted coaxial plug on the jack, so that either of two different resonant frequencies may be selected.

4. The apparatus of claim 2, wherein said second transmission line means further includes a coaxial line having a center conductor connected through the circuit board to said third point and an outer conductor connected to said ground plane, so that the resonant frequency of said radiating element may be selected in accordance with the length of the coaxial line and whether the coaxial line is open or short circuited.

5. The apparatus of claim 2, wherein said first point is at the edge of said radiating element opposite the second point, wherein said first transmission line means includes a microstrip line etched on the front side of said board from the first point to a fourth point to form an input impedance transformer having substantially the same dimensions as said terminating impedance transformer, the first transmission line means further including a coaxial line having an inner conductor connected through the circuit board to the first point and an outer conductor connected to said ground plane.

6. The apparatus of claim 5, further including a coaxial jack mounted on said back side of the board with a center conductor connected through the circuit board to said third point and an outer conductor connected to said ground plane, wherein said impedance terminating the second transmission line may selectively be an open circuit at said jack or a short circuit formed by placing a shorted coaxial plug on the jack, so that either of two different resonant frequencies may be selected.

7. The apparatus of claim 6, further including at least one length of coaxial line having a plug on one end for connection to said jack and selectively either a short or open connection at the other end to provide for the selection of additional resonant frequencies.

8. The apparatus of claim 7, wherein for each resonant frequency when selected, said standing wave ratio is less than 1.5, with a relatively narrow bandwidth compared to the variation between the minimum and maximum resonant frequencies which may be selected.

* * * * *